US005954950A

United States Patent [19]

Morel et al.

[11] Patent Number: 5,954,950

[45] **Date of Patent: *Sep. 21, 1999**

[54] INTENSIVE HYDROFINING OF PETROLEUM FRACTIONS

[75] Inventors: Frédéric Morel, Sainte Foy Les Lyon; Pierre Trambouze, Caluire; Jean-Paul Euzen, Dardilly; Stéphane Kressmann, Serezin du Rhone, all of France

[73] Assignee: Institut Francais Du Petrole, France

[ * ] Notice: This patent issued on a continued prosecution application filed under 37 CFR 1.53(d), and is subject to the twenty year patent term provisions of 35 U.S.C. 154(a)(2).

[21] Appl. No.: 08/524,631

[22] Filed: Sep. 7, 1995

[51] Int. Cl.[6] ..... C10G 25/00

[52] U.S. Cl. ..... 208/213; 208/209; 208/216 R

[58] Field of Search ..... 208/251 H, 216 R, 208/254 H, 213

[56] References Cited

U.S. PATENT DOCUMENTS

| | | | |
|---|---|---|---|
| 3,492,220 | 1/1970 | Lempert et al. | 208/144 |
| 3,493,492 | 2/1970 | Sze | 208/255 |
| 4,659,452 | 4/1987 | Howell | 208/89 |
| 4,659,453 | 4/1987 | Kukes et al. | 208/108 |
| 4,708,784 | 11/1987 | Howell et al. | 208/251 H |
| 4,802,772 | 2/1989 | Kukes et al. | 208/251 H |

FOREIGN PATENT DOCUMENTS

| | | |
|---|---|---|
| 0 212 202 | 3/1987 | European Pat. Off. . |
| 0 554 151 | 8/1993 | European Pat. Off. . |
| 0 602 287 | 6/1994 | European Pat. Off. . |
| 1 486 678 | 10/1967 | France . |
| 2 214 516 | 8/1974 | France . |
| 0 212 202 | 6/1989 | France . |
| 866 395 | 4/1961 | United Kingdom . |

OTHER PUBLICATIONS

Tausucher and Streiff, "Static Mixing of Gases", *Chemical Engineering Prog.* vol. 75(4):61–65, Apr. 1979.

Les réacteurs chimiques, conception, calcul et mise en oeuvre [Chemical Reactors, Design, Calculation and Use], Technip Editions, pp. 599–604, 1984.

*Primary Examiner*—Helane Myers

*Attorney, Agent, or Firm*—Millen, White, Zelano & Branigan, P.C.

[57] ABSTRACT

Intensive hydrofining of petroleum fractions wherein an at least partly together with hydrogen circulate in a given direction, in at least one reactor containing at least one fixed bed of a hydrofining catalyst in solid form, is characterized in that the reactor is equipped with at least one inlet pipe for the mixture of the petroleum fraction and hydrogen and at least one outlet pipe for the resultant hydrofined petroleum fraction, and that at least one static mixer is positioned upstream from said outlet of the hydrofined petroleum fraction.

23 Claims, No Drawings

INTENSIVE HYDROFINING OF PETROLEUM FRACTIONS

CROSS-REFERENCE TO RELATED APPLICATION

This application is related to the assignee's concurrently filed application U.S. Ser. No. 08/524,573, entitled "Selective Hydrogenation of Hydrocarbon Cuts Containing Monounsaturated and Polyunsaturated Hydrocarbons", by Trambouze, Euzen, Leger and Delhomme, now U.S. Pat. No. 5,817,901 based on French priority Application 94/10943 filed Sep. 8, 1994, both applications being incorporated by reference herein.

BACKGROUND OF THE INVENTION

This invention relates to the field of hydrofining (hydrodesulfurization and/or hydrodenitrogenization) of petroleum fractions and in particular to the hydrofining of fuel distillates. This invention applies in particular to hydrodesulfurization of gas oil fractions for the production of engine gas oils that meet future specifications as regards sulfur. It also applies to the intensive hydrodenitrogenization of fuel distillates, particularly with a view to subsequent hydrocracking of them. In the case of hydrodesulfurization, the sulfur specification will soon be 500 ppm in most countries. In Europe, this specification will be mandatory starting on Oct. 1, 1996. In the near future, the specification will be even more strict; values of 50 ppm of sulfur or even less are often mentioned. In the text below, this invention is described in connection with hydrodesulfurization; however, desulfurization shall not be considered a limitation of this process.

The gas oil fractions being used in the production of engine gas oils may come from various sources; they may be gas oil fractions from direct distillation or gas oil fractions from processes of hydrocarbon conversion, for example, catalytic cracking, hydrocracking, visbreaking, the coking process, or various catalytic residue hydroconversion processes, or it may be a mixture of several of these fractions. These gas oil fractions contain variable amounts of sulfur, ranging typically from 0.2% to 28 weight. To bring the sulfur content of these fractions to the level of future specifications, it is necessary to process them by the catalytic hydrodesulfurization process (HDS).

In the HDS process, the adjustment parameters ordinarily used to adjust the sulfur content are the increase in the temperature of the reactor, the increase in the hydrogen pressure, and the increase in the residue time of the fluids in the reactor. When one or more of these three adjustment parameters is increased, however, there is a tendency, not provided for by kinetic laws, for desulfurization levels to level off when the sulfur level becomes very low. This degradation in desulfurization performance is in particular very significant in the case where the fluids flow from top to bottom in a reactor that works with downward flow. This problem therefore greatly limits the chances for industrial development of such a process using reactors often called "trickle bed" reactors by ones skilled in the art, for the production of engine gas oils with very low sulfur contents.

Without being bound by any particular theory, it seems that this degradation in reactor performance is due, at least partly, to problems in the distribution of fluids and the segregation of the gaseous and liquid phases, which has the effect that a portion of the liquid passes through the reactor along preferential paths (short circuits), therefore desulfurizes poorly and winds up contaminating the product at the output of the reactor.

SUMMARY OF THE INVENTION

An object of the invention is, therefore, to find a way or a method that makes it possible to obtain a distribution of fluids that is as uniform as possible, approximating as much as possible a piston flow to guarantee a very high desulfurization level at the output of the reactor.

Upon further study of the specification and appended claims, further objects and advantages of this invention will become apparent to those skilled in the art.

This invention proposes a solution to this problem that makes it possible to greatly improve the desulfurization rates, particularly when very low sulfur contents are desired.

This invention therefore proposes a means that makes it possible to mix the liquid and gaseous phase(s) before making contact with the catalyst bed (and preferably in front of each bed) and makes it possible to ensure a homogeneous distribution of said mixture over the entire section of the catalyst bed.

This invention relates more specifically to a process of intensive desulfurization of petroleum fractions, preferably gas oil fractions for the production of engine gas oils, in which said fraction, at least partly in the liquid phase, and hydrogen circulate in a given direction, in at least one reactor that contains at least one fixed bed of a hydrofining catalyst, preferably a hydrodesulfurization catalyst, in solid form (generally granulated), characterized in that said reactor is equipped with at least one pipe for input of the mixture of fluids that comprise said petroleum fraction and hydrogen and at least one pipe for output of the hydrofined petroleum fraction, and in that it comprises at least one static mixer upstream from said output of the hydrofined petroleum fraction.

Preferably, the process is used with several reactors, with at least one of the reactors, and preferably all the reactors, being as specified by the invention.

Most often, the reactor will be a reactor that is extended along an axis; the reactor's section, which can be of any type, is most often square, rectangular, or circular. Usually, a reactor which has a circular section and which further comprises an input pipe that empties into the reactor is used, usually in such a way that the fluids are introduced in the direction of the axis of said reactor, with an output pipe usually being oriented, at least in the immediate vicinity of the reactor, along the axis of said reactor. The reactor diameters are generally on the order of 1 m to 5 m, and preferably 2 to 4 m.

Within the scope of this invention, one of the static mixers that are well known to one skilled in the art will be used. By way of nonlimiting examples of static mixers, it is possible to use one of those described and sold by the SULZER Company and, for example, those known under reference SMV or SMX, described in particular in the journal *Chemical Engineering Progress*, Vol. 75, No. 4, April 1979, pages 61 to 65. Another type of static mixer is also described in patent EP-B212 202. Descriptions of a static mixer that can be used within the scope of this invention will also be found in the book entitled "Les réacteurs chimiques, conception, calcul et mise en oeuvre [Chemical Reactors, Design, Calculation, and Use]," published by TECHNIP Editions in 1984, in particular pages 599 to 605.

According to a particular embodiment of the process according to this invention, at least one static mixer will be located in the pipe for input into the reactor of the fluid mixture that comprises said fraction and hydrogen.

According to another embodiment, at least one static mixer is located in the reactor upstream from the catalyst bed, in the direction in which the fluids pass through the reactor, with said mixer also performing the function of fluid distribution.

According to another variant, at least one static mixer is located in the reactor upstream from the catalytic bed, in the direction in which the fluids pass through the reactor. For example, if the reactor comprises several beds, there can be at least one static mixer between two successive beds.

In a particular embodiment of the invention, the reactor comprises at least one static mixer in which at least a portion of the catalyst is distributed, with the remainder of said catalyst being above and/or below said static mixer. According to this latter use, the static mixer can, in a particular version, contain all of the catalyst.

In a preferred embodiment of the invention, the catalyst is charged into the reactor by a dense-charging device (for example, by the device described by IFP under the commercial name of CATAPAC) which ensures a uniform and compact distribution of the catalyst grains in the chamber of the reactor.

Several static mixers can be used simultaneously and arranged according to one of the embodiment versions described above. When the static mixer is not directly upstream from the catalyst bed (or the bed of noncatalytic solid particles if the catalyst bed is preceded by such a bed of solid particles), a standard distribution plate, such as, for example, one of those described on page 308 or on page 490 of the work cited above, is most often placed upstream from this bed. This plate for distributing or redistributing fluids can be upstream or downstream (in the direction of circulation of the fluids) from a static mixer. When the static mixer is directly upstream from the bed of solid particles, a fluid distributor will be used only if this static mixer does not perform this distribution function at the same time. One or more catalyst bed(s) or inert material(s) whose grain size is smaller than that of the hydrofining catalyst that is located directly upstream can also be used in place of the fluid distributor.

Most often, the static mixer will consist of plates which are arranged at a certain angle and which are stacked in such a way as to form open channels which cross, arranged obliquely relative to the axis of the reactor.

According to an advantageous embodiment of the invention, the reactor will contain a number of fixed beds that each contain a hydrofining catalyst, preferably a desulfurization catalyst, which is the same or differs from one bed to the next, separated from one another by means that ensure the collection of fluids that are exiting a catalyst fixed bed, the mixing of the fluids thus collected, and the redistribution of this mixture on the catalyst fixed bed located downstream in the general direction of circulation of said fluids in said reactor. In the case where the reactor contains a number of catalytic beds, it is particularly advantageous for each means that ensures the collecting of fluids, their mixing, and their redistribution to comprise at least one means of introducing gas or cold liquid (for example, cold gaseous hydrogen) into the collected mixture. Still within the framework of this embodiment of the invention, the means that is located between two catalyst beds and ensures the collection of fluids, their mixing and their redistribution can be a static mixer that performs all of these functions. It would still be within the scope of this invention, however, to use a static mixer that does not perform the function of redistributing fluids and then attaching to it a standard fluid distributor. The means for distributing or redistributing fluids is preferably either a catalyst bed or a bed of inert material whose grain size is smaller than that of the hydrofining catalyst, or a distributor plate that consists of, for example, a plate with holes.

In a particularly preferred approach according to the invention, the static mixer(s) in the reactor occupies (occupy) the entire section of the reactor or, more accurately, the mixer covers a section that is at least equal to that of the upstream bed and/or at least equal to that of the downstream bed (except for the mixer located in the input pipe). In this way, the rates of flow in the bed(s) and the mixer(s) are essentially identical. All combinations of the variants described are possible.

The process of this invention applies in the case where the hydrocarbon fraction and hydrogen circulate from top to bottom in the reactor as well as in the case where these fluids circulate from bottom to top.

It should be noted, however, that the improvement in performance is clearly greater in the case of a downward-flow reactor, which is thus the preferred case of application of the process of this invention.

Within the framework of this invention, the hydrofining (desulfurization) catalyst in solid form that is used is a standard catalyst such as, for example, catalyst HR316C, which is marketed by the Procatalyse company.

The operating conditions that can be applied to catalytic hydrofining processes are the conditions known to one skilled in the art and more particularly an average temperature of between 300 and 400° C., a pressure of between 2 and 10 Mpa and preferably between 4 and 8 Mpa, a volumetric flow rate of between 0.5 and 5 volumes of liquid charge per hour and per volume of catalyst, and a hydrogen recycle rate of between 50 and 1000 volumes of hydrogen per volume of fresh charge.

All catalysts that are actively used in hydrofining are suitable, in particular those known in hydrodesulfurization of gas oils for application to gas oils.

Each reactor can operate with a charge flow without product recycling or with partial product recycling. In order to control the exothermicity of the reaction, a portion of the cold hydrogen recycle (quench) is often injected into the unit at the level of one or more of the static mixers installed in the unit. The number of quenches will be greater, the larger the proportion of products to be hydrofined (in particular gas oils) coming from conversion processes in the charge of the unit (in particular hydrodesulfurization).

Without further elaboration, it is believed that one skilled in the art can, using the preceding description, utilize the present invention to its fullest extent. The following preferred specific embodiments are, therefore, to be construed as merely illustrative, and not limitative of the disclosure in any way whatsoever.

In the foregoing and in the following examples, all temperatures are set forth uncorrected in degrees Celsius and unless otherwise indicated, all parts and percentages are by weight.

The entire disclosures of all applications, patents and publications, cited above and below, are hereby incorporated by reference.

The following examples, without limiting the scope of the invention, show the improvement in the level of desulfurization obtained by using the process of the invention.

EXAMPLE 1 (COMPARATIVE)

A catalyst comprising an alumina support, in the form of extrudates, sold by the PROCATALYSE company under commercial reference HR316C, is used. The catalyst is charged into a reactor, which is elongated along an approximately vertical axis, with an approximately circular section. The amount of catalyst that is charged into the reactor is 7 liters. Before it is used, this catalyst is presulfurized by running through it a gas oil direct-distillation fraction diluted with DMDS, with a final stage of 12 hours at 350° C. The catalyst bed is mounted above a fluid distributor. The reactor comprises a pipe for input of the mixture of hydrogen and the gas oil fraction in question, whose analysis is given in Table 1 below. The mixing of the hydrogen and the gas oil fraction is carried out by introducing hydrogen into the input pipe of the reactor. The desulfurization of the gas oil fraction is performed with downward flow under the following operating conditions:

| | |
|---|---|
| Hydrogen pressure | 2.5 MPa (25 bar) |
| Temperature | 350° C. |
| Hydrogen/gas oil ratio | 250 l/l |

The product obtained after desulfurization is recovered at the bottom of the reactor, and a portion of the product is analyzed. The results presented in Table 1 below are the averages of analyses performed every two hours during the operation of the reactor. The test lasted 300 hours.

TABLE 1

| | Charge | Product |
|---|---|---|
| Density 15/4 | 0.852 | 0.838 |
| Sulfur (ppm) | 14800 | 600 |
| Nitrogen (ppm) | 110 | 60 |
| Distillation ASTM D86 | | |
| PI | 223 | 214 |
| 10% | 258 | 251 |
| 30% | 280 | 272 |
| 50% | 299 | 291 |
| 70% | 324 | 315 |
| 90% | 359 | 351 |
| PF | 383 | 376 |

The sulfur content of the product is 600 ppm. The product therefore does not meet international standards.

EXAMPLE 2

The same reactor as in Example 1, the same operating conditions, and the same catalyst in an identical amount are used, but this time the reactor contains two catalyst beds that are separated by an SMV type static mixer which is sold by the SULZER company, to which is attached a liquid distributor directly below this static mixer. As in Example 1, the reactor comprises a fluid distributor above the first bed. The static mixer is formed by three successive slates offset by 90 degrees relative to one another, as is described in the journal *Chemical Engineering Progress*, Vol. 75, No. 4, April 1979, pages 61 to 65.

Each plate has a height of 10 cm. The product that is obtained after desulfurization is recovered at the bottom of the reactor and a portion of the product is analyzed. The results presented in Table 2 below are the averages of analyses performed every two hours during the operation of the reactor. The test lasted 300 hours.

TABLE 2

| | Charge | Product |
|---|---|---|
| Density 15/4 | 0.852 | 0.838 |
| Sulfur (ppm) | 14800 | 485 |
| Nitrogen (ppm) | 110 | 55 |
| ASTM D86 | | |
| PI | 223 | 214 |
| 10% | 258 | 251 |
| 30% | 280 | 272 |
| 50% | 299 | 291 |
| 70% | 324 | 315 |
| 90% | 359 | 351 |
| PF | 383 | 376 |

The sulfur content of the product is 485 ppm. This time, the product therefore meets international standards of 500 ppm.

EXAMPLE 3 (COMPARISON)

The same reactor as in Example 1, the same operating conditions, and the same catalyst but in a larger amount are used. The volume of catalyst charged into the reactor is 21 liters. The reactor contains a single catalyst bed. The desulfurization of the gas oil fraction is performed with a downward flow.

The results presented in Table 3 below are the averages of the analyses performed every two hours during the operation of the reactor. The test lasted 300 hours.

TABLE 3

| | Charge | Product |
|---|---|---|
| Density 15/4 | 0.852 | 0.836 |
| Sulfur (ppm) | 14800 | 105 |
| Nitrogen (ppm) | 110 | 22 |
| ASTM D86 | | |
| PI | 223 | 210 |
| 10% | 258 | 245 |
| 30% | 280 | 269 |
| 50% | 299 | 289 |
| 70% | 324 | 311 |
| 90% | 359 | 348 |
| PF | 383 | 372 |

The sulfur content of the product is 105 ppm. The product therefore does not meet planned future international standards, calling for a level of 50 ppm.

EXAMPLE 4

The same reactor as in Example 3, the same operating conditions, and the same catalyst in an identical amount are used, but the reactor contains three catalyst beds, each separated by an SMV type static mixer that is sold by the SULZER company, to which is added a liquid distributor directly below this static mixer. Each static mixer is identical to the one used in Example 2. The results presented in Table 4 below are the averages of analyses performed every two hours during the operation of the reactor. The test lasted 300 hours.

TABLE 4

| | Charge | Product |
|---|---|---|
| Density 15/4 | 0.852 | 0.836 |
| Sulfur (ppm) | 14800 | 45 |
| Nitrogen (ppm) | 110 | 20 |
| ASTM D86 | | |
| PI | 223 | 210 |
| 10% | 258 | 245 |
| 30% | 280 | 269 |
| 50% | 299 | 289 |
| 70% | 324 | 311 |
| 90% | 359 | 348 |
| PF | 383 | 372 |

The sulfur content of the product is 45 ppm. This time, therefore, the product meets planned future international standards of 50 ppm.

The examples above show that the process of the invention makes it possible to obtain better desulfurization with the same operating conditions (Examples 1 and 2, on the one hand, and 3 and 4, on the other hand). The advantage of the process is greater, the higher the desired desulfurization level. Thus, for Examples 1 and 2, when the goal is to obtain a sulfur content of less than 500 ppm, it is relatively easy to reduce the sulfur content from 600 to 500 ppm by adjusting the reaction temperature while also reducing the length of the cycle; on the other hand, for the second series of Examples No. 3 and 4, it is virtually impossible to go from a sulfur content of more than 100 ppm to a content of less than 50 ppm by a simple increase of the reaction temperature because of a poor distribution of the fluids at some spots in the reactor. This process here provides a very significant advantage by making it possible to obtain very intensively desulfurized gas oils.

The process according to the invention therefore makes it possible:

- to mix the liquid and gaseous phases entering into the reactor when a mixer is located in the input pipe,
- to mix the liquid and gaseous phases in front of the bed to ensure a gas/liquid transfer to dissolve the hydrogen, so that, a liquid composition is achieved with a large concentration of dissolved gas upon contact with the active solid,
- to remix the various liquid or gas flows, coming from various zones of an upstream bed, which are more or less well separated and which can each exhibit differences of composition, before bringing them into contact with a downstream bed,
- optionally to mix the hydrogen or the liquid injected at said mixer with the liquid and gaseous phases present in the reactor,
- to distribute over the entire section of the bed said mixture of phases in a homogeneous way, with the flows of liquid and gas each having equal compositions over the entire section of the bed,
- in parallel, to balance the temperatures over an entire section,
- and to improve the distribution of the residence times of the reagents by limiting the back-mixing of the reagents and products and therefore to improve both conversion and selectivity.

The preceding examples can be repeated with similar success by substituting the generically or specifically described reactants and/or operating conditions of this invention for those used in the preceding examples.

From the foregoing description, one skilled in the art can easily ascertain the essential characteristics of this invention, and without departing from the spirit and scope thereof, can make various changes and modifications of the invention to adapt it to various usages and conditions.

What is claimed:

1. A process of intensive hydrofining of a petroleum fraction which comprises circulating a mixture of the petroleum fraction, at least partly in the liquid phase, with hydrogen in a given direction, in at least one reactor that contains at least one fixed bed of a hydrodesulfurization hydrofining catalyst in solid form, wherein said reactor is equipped with at least one pipe for input of said mixture of petroleum fraction and hydrogen and at least one pipe for output of the hydrofined petroleum fraction and wherein said mixture is mixed in at least one static mixture located upstream from said at least one fixed bed, the static mixer also performing the function of fluid distillation.

2. A process according to claim 1, wherein the process of intensive hydrofining is a process of intensive desulfurization of a gas oil fraction for the production of engine gas oils.

3. A process according to claim 1, wherein the process of intensive hydrofining is a process of intensive hydrodenitrogenization of crude distillates.

4. A process according to claim 1, wherein, downstream from the static mixer in the direction of circulation of the fluids, the reactor comprises at least one device for distributing or redistributing fluids and the mixture is treated by said at least one device.

5. A process according to claim 4, wherein the means for redistributing fluids is formed by one or more catalyst bed(s) or inert material(s) whose grain size is smaller than that of the hydrofining catalyst.

6. A process according to claim 4, wherein the means for redistributing fluids is a distributing plate that consists of a plate with holes.

7. A process according to claim 1, wherein said at least one static mixer is located in the pipe for input into the reactor of the mixture of fluid that comprises said petroleum fraction and hydrogen.

8. A process according to claim 1, wherein the said at least one static mixer contains at least a portion of catalyst, with the remainder of said catalyst being above and/or below said static mixer.

9. A process according to claim 8, wherein the static mixer contains all of the catalyst.

10. A process according to claim 1, wherein the petroleum fraction and hydrogen circulate from top to bottom in the reactor.

11. A process according to claim 1, wherein the petroleum fraction and hydrogen circulate from bottom to top in the reactor.

12. A process according to claim 1, wherein the static mixer consists of plates which are arranged at a certain angle and which are stacked to form open channels that intersect, arranged obliquely relative to the axis of the reactor.

13. A process according to claim 1, wherein said reactor contains at least two fixed beds that each contain a hydrofining catalyst, which is the same or differs from one bed to the next, said at least two fixed beds being, separated from one another by a static mixer that ensures the collection of fluids which exit from a catalyst fixed bed, the mixing of fluids thus collected, and the redistribution of this mixture on the fixed catalyst bed located downstream of said static mixer in the general direction of circulation of said fluids in said reactor.

14. A process according to claim 13, wherein the process of intensive hydrofining is a process of intensive desulfurization of a gas oil fraction for the production of engine gas oils.

15. A process according to claim 13, wherein the process of intensive hydrofining is a process of intensive hydrodenitrogenization of crude distillates.

16. A process according to claim 13, wherein the petroleum fraction and hydrogen circulate from top to bottom in the reactor.

17. A process according to claim 13, wherein the petroleum fraction and hydrogen circulate from bottom to top in the reactor.

18. A process according to claim 13, wherein the hydrogen and liquid petroleum fraction are mixed in the static mixer upstream of the fixed bed to ensure a gas/liquid transfer to dissolve the hydrogen to form a liquid with an enriched concentration of hydrogen.

19. A process according to claim 1, wherein the catalyst is charged into the reactor with a dense-charging device.

20. A process according to claim 1, wherein the hydrogen and liquid petroleum fraction are mixed in the static mixer upstream of the fixed bed to ensure a gas/liquid transfer to dissolve the hydrogen to form a liquid with an enriched concentration of hydrogen.

21. The process of claim 1, wherein the static mixer occupies a cross section of the reactor at least equal to the cross section of the fixed bed.

22. The process of claim 1, wherein the static mixer occupies the entire cross section of the reactor.

23. The process of claim 1, wherein the hydrofining is conducted at an average temperature from 300 to 400° C., a pressure from 2 to 10 MPa, a volumetric flow rate of from 0.5 to 5 volumes of liquid per hour and per volume of catalyst and with a hydrogen recycle at a rate of from 50 to 1000 volumes of hydrogen per volume of hydrogen charge.

* * * * *